US006361726B1

(12) United States Patent
Kim

(10) Patent No.: US 6,361,726 B1
(45) Date of Patent: Mar. 26, 2002

(54) METHOD AND APPARATUS FOR MAKING INNER PACKAGING CONTAINER HAVING ANTI-ELECTROSTATIC CHARACTERISTICS, USING PAPER MAKING PROCESS

(76) Inventor: Soon-Jai Kim, No. 75-19, Nokbon-dong, Eunpyong-gu, Seoul (KR)

( * ) Notice: Subject to any disclaimer, the term of this patent is extended or adjusted under 35 U.S.C. 154(b) by 0 days.

(21) Appl. No.: 09/418,841

(22) Filed: Oct. 15, 1999

(51) Int. Cl.[7] ..... B28B 1/52
(52) U.S. Cl. ..... 264/87; 425/85
(58) Field of Search ..... 264/87; 425/85

(56) References Cited

U.S. PATENT DOCUMENTS 4,836,875 A * 6/1989 Buttermore et al. ..... 264/87
5,104,598 A * 4/1992 Dolle ..... 425/85
5,766,647 A * 6/1998 Kuzusako ..... 425/85

* cited by examiner

*Primary Examiner*—Mary Lynn Theisen
(74) *Attorney, Agent, or Firm*—Harrison & Egbert

(57) ABSTRACT

A method and apparatus for making an inner packaging container, in which fiber components of a pulp slurry, which is prepared by dissolving or dispersing pulp, carbon fibers, and sparsely acetificated PVA fibers in water together with sizing agents and additives, are deposited to a desired thickness over a mold surface of a lower mold perforated with a number of pores and defined with a suction chamber, under the condition in which the lower mold is immersed in the pulp slurry, using a reduction of pressure occurring in the suction chamber, and molded into a desired shape by the lower mold along with an upper mold engaging with the lower mold, thereby forming a conductive packaging container having an integral structure.

2 Claims, 2 Drawing Sheets

METHOD AND APPARATUS FOR MAKING INNER PACKAGING CONTAINER HAVING ANTI-ELECTROSTATIC CHARACTERISTICS, USING PAPER MAKING PROCESS

BACKGROUND OF THE INVENTION

1. Field of the Invention

The present invention relates to a method and apparatus for making an inner packaging container, having anti-electrostatic characteristics, from an aqueous slurry of pulp dispersed with carbon fibers by use of a mold adapted to be immersed in the pulp slurry and a suction means. In particular, the present invention relates to a method and apparatus for making an inner packaging container, in which fiber components of a pulp slurry, which is prepared by dissolving or dispersing pulp and carbon fibers in water together with sizing agents and additives, are deposited over a mold surface of a lower mold perforated with a number of pores and defined with a suction chamber, under the condition in which a reduction of pressure occurs in the suction chamber, and molded into a desired shape by the lower mold along with an upper mold engaging with the lower mold, and then subjected to dewatering, separating and drying processes, thereby forming an anti-electrostatic packaging container having an integral structure.

2. Description of the Prior Art

In regard to inner packaging materials for packaging an article having a specific shape, packaging containers have been known which are made of planar white boards, hard boards, or corrugated sheets. Such packaging containers are made by cutting a board or sheet into a desired shape, and then folding or bending the cut board or sheet into a shape desired to be in tight contact with an article to be packaged. However, it is difficult for such packaging containers to have a shape conforming to the shape of an article to be packaged because the manufacture of such packaging containers involves many processes such as cutting, folding, bending, and bonding processes. As a result, it is impossible to expect a precise packaging.

In order to solve such a problem, inner packaging containers made of synthetic resin foam have been proposed. Although such packaging containers provide a stable and precise packaging, they involve a problem in regard to environmental pollution. Furthermore, it is impossible to expect, from such packaging containers, an anti-electrostatic effect which is desired in accordance with the present invention.

Recently developed electronic elements and electronic appliances, which consist of highly dense integrated circuits, may be damaged by even weak static electricity. As a result, expensive electronic products may be out of order or operate abnormally. The generation of static electricity may also involve a danger of an accident such as burning of inflammables having a low fire point or an explosion of explosive materials, for example, gunpowder.

In order to eliminate such problems, aluminum foils have been proposed which are used to package products by units. Also, anti-electrostatic packaging materials have been proposed which are coated with a coating consisting of carbon powder mixed with an appropriate paint.

However, packaging materials such as aluminum foils are expensive in regard to the costs of the material used and the costs of labor. Aluminum foils may cause damage to packaged articles due to a high hardness thereof. On the other hand, anti-electrostatic packaging materials coated with a coating may dissolve parts of electronic elements or electronic appliances made of synthetic resin because the coating contains an organic solvent, drying oil or semi-drying oil. As a result, the packaged articles may be damaged. Furthermore, the packaged articles may be contaminated with the coating. Bad odor may also be generated from such packaging materials.

Recently, a conductive packaging sheet has also been proposed which is disclosed in Korean Patent Publication No. 92-169.

This conductive packaging sheet is made of pulp and carbon fibers in accordance with a papermaking process. Such a conductive packaging sheet may be used to directly wrap an electronic element or electronic appliance. Otherwise, it is used in the form of an inner packaging container having a certain shape after being bonded to a white board, hard board or corrugated board, and then subjected to cutting, folding and bending processes.

Although such a packaging container is conductive, it exhibits a degraded packaging tightness. For this reason, it is impossible to expect a precise packaging using such a packaging container. This packaging container cannot be regarded to be a high-grade packaging container.

SUMMARY OF THE INVENTION

Therefore, an object of the invention is to provide a method and apparatus for making a packaging material exhibiting a conductivity while having a high quality so as to enhance the performance and competitiveness, taking into consideration the current global tendency to avoid the use of packaging containers made of synthetic resin materials resulting in environmental pollution.

In accordance with one aspect, the present invention provides an apparatus for making an anti-electrostatic packaging container comprising: a pulp slurry making tank; a molding tank for receiving a pulp slurry supplied from the pulp slurry making tank via a pipe; a hydraulic device arranged beneath the molding tank, the hydraulic device having a vertically reciprocating piston extending vertically through a bottom wall of the molding tank into the interior of the molding tank; a lower mold arranged in the interior of the molding tank and mounted at a bottom wall thereof to an upper end of the piston in such a fashion that it moves vertically in the molding tank in accordance with a reciprocal movement of the piston, the lower mold having a top wall perforated with a number of pores and adapted as a lower surface of a mold cavity; the suction chamber defined in the lower mold beneath the top wall of the lower mold and connected to a motor installed outside the molding tank via a flexible hose extending from the motor to the interior of the molding tank, the suction chamber communicating with the interior of the molding chamber via the pores perforated through the top wall of the lower mold; an upper mold arranged in a fixed state near a top wall of the molding tank in the interior of the molding tank in such a fashion that it is vertically aligned with the lower mold, the upper mold engaging with the lower mold at edges thereof to define said mold cavity therebetween and having a bottom wall perforated with a number of pores and adapted as an upper surface of the mold cavity; and an air sucking and blowing chamber defined in the upper mold and connected to a reversible motor installed outside the molding tank via an air pipe extending from the reversible motor to the upper mold, the air sucking and blowing chamber communicating with the mold cavity via the pores perforated through the bottom wall of the upper mold.

In accordance with another aspect, the present invention provides a method for making an anti-electrostatic packaging container using the above mentioned packaging container making apparatus according to the present invention, comprising the steps of: dispersing beaten sulfite pulp and carbon fibers in water, adding, to the resulting aqueous solution, rosin and aluminum sulfate as sizing agents, sparsely acetificated PVA fibers and a melamine resin or urea resin as additives, and a starch material, and sufficiently stirring the resulting mixture in the pulp slurry making tank, thereby producing a pulp slurry; supplying the pulp slurry from the pulp slurry making tank to the molding tank until the lower mold is completely immersed in the supplied pulp slurry in the molding tank; generating a suction force in the suction chamber by an operation of the motor, thereby depositing fiber components of the pulp slurry to a desired thickness over the top wall of the lower mold; stopping the operation of the motor, and then upwardly moving the lower mold by an operation of the hydraulic device until the lower mold comes into contact with the upper mold, thereby molding said deposited fiber components of the pulp slurry into a packaging container while dewatering the molded packaging container; generating a suction force in the air sucking and blowing chamber by a normal operation of the reversible motor while downwardly moving the lower mold, thereby separating the molded packaging container from the lower mold; blowing air into the air sucking and blowing chamber by a reverse operation of the reversible motor, thereby separating the molded packaging container from the upper mold; and drying and curing the molded packaging container for 10 to 20 minutes while passing said molded packaging container through a drying tunnel maintained at a temperature of 50 to 120° C.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

In accordance with the present invention, inner packaging containers having anti-electrostatic characteristics are made from an aqueous slurry of pulp dispersed with carbon fibers, using a pulp slurry making process, a molding process, a drying process, and a cutting process. The pulp slurry making process and molding process are carried out in an apparatus of FIG. 1 which has a configuration according to the present invention. The present invention will be described in detail in conjunction with those processes.

1. Pulp Slurry Making Process

A mixture of beaten sulfite pulp and carbon fibers is dispersed in water, and then added with rosin and aluminum sulfate as sizing agents, sparsely acetificated PVA fibers and melamine resin or urea resin as additives, and a starch material. The resultant mixture is then sufficiently stirred, thereby producing a pulp slurry.

In the mixture of the milled sulfite pulp and carbon fibers, the milled sulfite pulp has a content of 85 to 90 by weight %, and the carbon fibers have a content of 10 to 15 by weight %. This mixture is dispersed in water so that it has a fiber concentration of 3 to 4%. The amount of the sparsely acetificated PVA fibers added to the water dispersed with the mixture is 3 to 4 by weight % based on the weight of the mixture. The melamine resin or urea resin is added to the water in an amount of 2 to 3 by weight % based on the weight of the mixture. The rosin is added in a concentration of 2 to 4% in the water. The aluminum sulfate is added in a concentration of 3 to 5% in the water. The resultant mixture is then sufficiently stirred.

2. Molding Process

Figure 1:
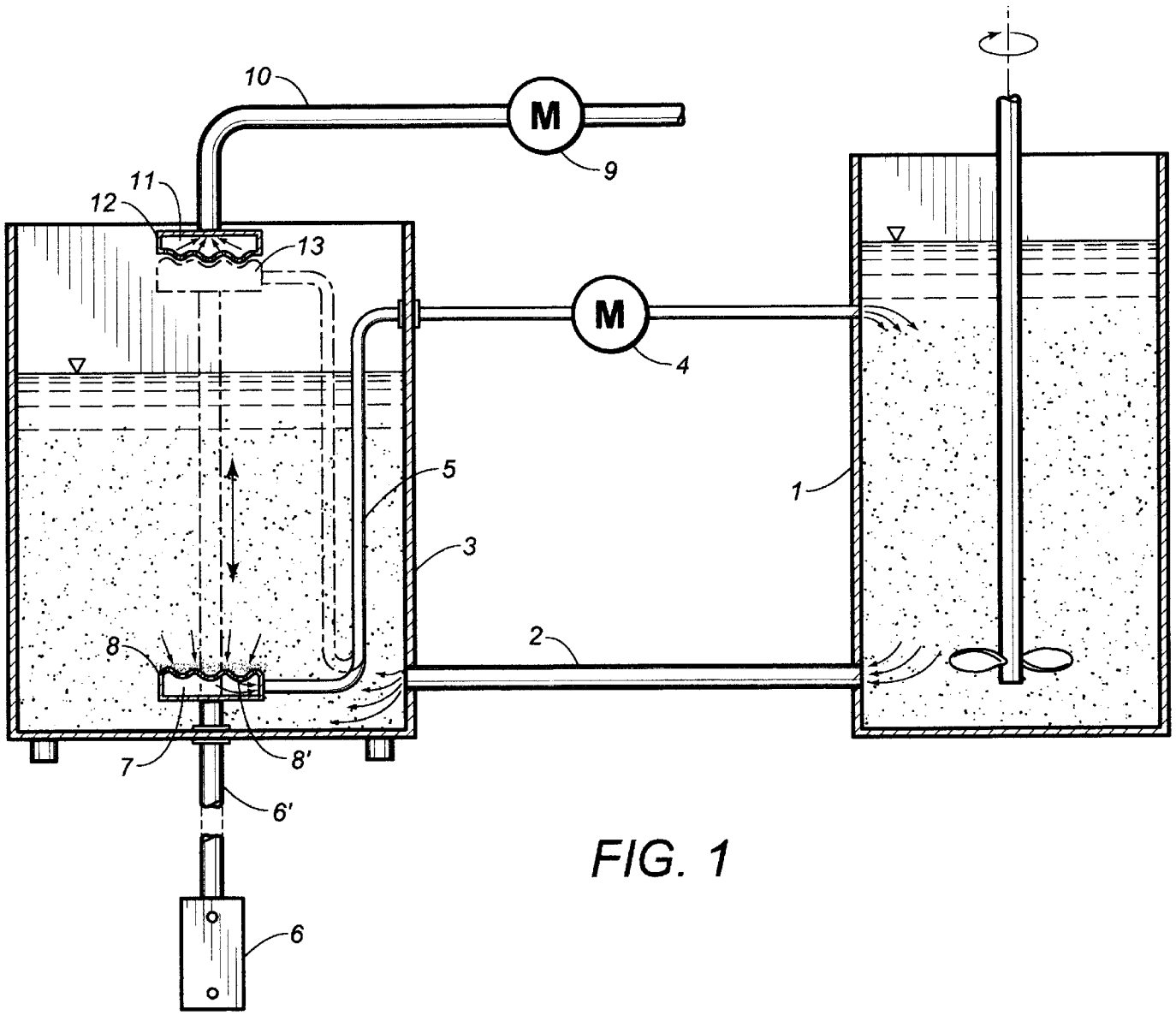
FIG. 1 is a schematic view illustrating an apparatus for making a packaging container in accordance with the present invention.

Referring to FIG. 1, a packaging container making apparatus, which is adapted to carry out a process for molding a packaging container from a pulp slurry prepared as mentioned above in accordance with the present invention, is illustrated. As shown in FIG. 1, the packaging container making apparatus of the present invention includes a pulp slurry making tank 1 for making a pulp slurry, and a molding tank 3 for receiving a pulp slurry supplied from the pulp slurry making tank 1 via a pipe 2. A hydraulic device 6 is arranged beneath the molding tank 3. The hydraulic device 6 has a vertically reciprocating piston 6' extending vertically through the bottom wall of the molding tank 3 into the interior of the molding tank 3. A lower mold 8 is arranged in the interior of the molding tank 3 and mounted at its bottom wall to the upper end of the piston 6' so that it moves vertically in the molding tank 3 in accordance with the reciprocal movement of the piston 6'. The lower mold 8 is defined therein with a suction chamber 7 which is connected to a motor 4 installed outside the molding tank 3 via a flexible hose 5 extending from the motor 4 to the interior of the molding tank 3. A number of pores 8' are perforated through the top wall of the lower mold 8. The perforated top wall of the lower mold 8 has a shape corresponding to that of the lower surface of a product, namely, a packaging container, to be molded. That is, the perforated top wall of the lower mold 8 serves as a lower mold surface. An upper mold 12 is arranged in a fixed state near the top wall of the molding tank 3 in the interior of the molding tank 3 in such a fashion that it is vertically aligned with the lower mold 8. The upper mold 12 is defined therein with an air sucking and blowing chamber 11 which is connected to a reversible motor 9 installed outside the molding tank 3 via an air pipe 10 extending from the motor 9 to the upper mold 12. A number of pores are perforated through the bottom wall of the upper mold 12. The perforated bottom wall of the upper mold 12 has a shape corresponding to that of the upper surface of the packaging container to be molded. That is, the perforated bottom wall of the upper mold 12 serves as an upper mold surface.

When the packaging container making apparatus having the above mentioned configuration according to the present invention operates to carry out a process for making a packaging container, a pulp slurry is first prepared in the pulp slurry making tank 1. The pulp slurry from the pulp slurry making tank 1 is then supplied to the molding tank 3 via the pipe 2 until the lower mold 8 is completely immersed in the supplied pulp slurry. In this state, the motor 4 operates to suck the pulp slurry into the suction chamber 7 of the lower mold 8 through the pores 8'. At this time, fiber components of the pulp slurry are deposited over the upper surface of the lower mold 8, namely, the lower mold surface. The motor 4 is stopped when the thickness of the fiber components of the pulp slurry deposited over the lower mold surface reaches a desired thickness. In this state, the hydraulic device 6 operates to upwardly move lower mold 8 mounted to the piston 6', so that the lower mold 8 comes into contact with the upper mold 12, thereby molding the deposited fiber components of the pulp slurry into a packaging container 13 while dewatering the molded packaging container 13. Thereafter, the reversible motor 9 drives to generate a suction force in the air sucking and blowing chamber 11. At the same time, the hydraulic device 6 operates to downwardly move the lower mold 8 from the upper mold 12. Accordingly, the molded packaging container 13 is separated from the lower mold 8 while being retained in the upper mold 12. In this state, the reversible motor 9 drives reversely to blow air into the air sucking and blowing chamber 11, thereby causing the molded packaging container 13 to be separated from the upper mold 12. Thus, a wet inner packaging container is obtained.

3. Drying Process

The packaging container 13 emerging from the molding process is then dried and cured for 10 to 20 minutes while being passed through a drying tunnel maintained at a temperature of 50 to 120° C.

4. Cutting Process

The edge of the dried and cured packaging container 13 is cut. Thus, an integral inner packaging container is obtained. The finally obtained packaging container has a thickness of 1 to 2 mm. The thickness of the packaging container may be adjusted within the above thickness range in accordance with the weight of a content packed by the packaging container.

Figure 2:
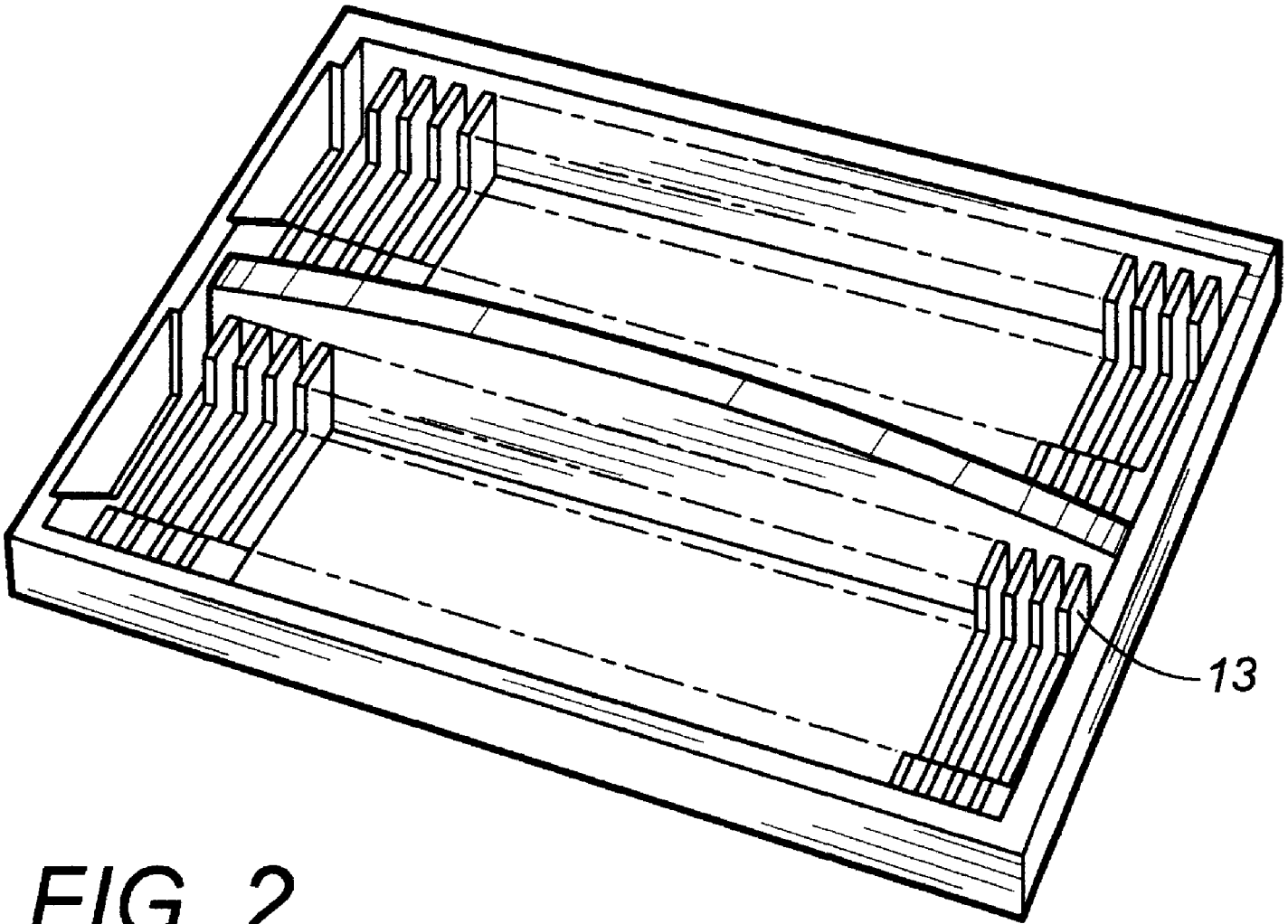
FIG. 2 is a perspective view illustrating a RAM tray molded in accordance with the present invention.

Referring to FIG. 2, a RAM tray is illustrated which is molded in accordance with the present invention.

Sulfite pulp used to prepare a pulp slurry for molding a packaging container according to the present invention has a property for achieving an easy beating thereof. Accordingly, a variety of pulp slurry with various viscosities can be prepared from sulfite pulp. In particular, fibers of sulfite pulp have a sufficient length and a large width because they mainly include trochoides. Accordingly, it is very difficult for the pulp slurry to pass through the fine pores of the molds. This results in an improvement in the workability. Carbon fibers exhibit a low tangling property because they have a low flexibility while exhibiting a high stiffness. For this reason, it is necessary to obtain a desired strength of such carbon fibers by the bondability of the pulp slurry. Since a packaging container having certain irregularities is molded in accordance with the present invention, it can not be subjected to any surface coating process for coating a sizing agent or other additives. In conventional papermaking methods, a paper web is subjected to a surface coating process while passing over a roller or drum. For this reason, an internal sizing process, in which a sizing agent and additives are dissolved or dispersed in the pulp slurry, is used in accordance with the present invention.

In this case, rosin is used in a state safonificated by alkali because it has a low water-soluble or dispersable property. Preferably, alkali (soda) is used in an insufficient amount in order to allow a small amount of free rosin to be present in the form of fine colloidal particles dispersed in an rosin-dissolved alkali solution. In this case, white color is exhibited. Accordingly, it is possible to avoid an exhibition of brown color caused by rosin.

Sparsely acetificated PVA fibers, which are used as an additive in accordance with the present invention, are very important in molding of the packaging container according to the present invention.

Since a considerable amount of conductive carbon fibers is used in accordance with the present invention, it is impossible to expect a high strength obtained by virtue of tangling of fibers, as in a paper web surface-processed while passing over a roller or drum. Accordingly, it is necessary to obtain a desired physical strength of the packaging container using a binder having a superior bondability.

In this connection, sparsely acetificated PVA fibers exhibit a property of being dissolved in water at a high temperature or in a wet state while exhibiting a low water-soluble property at a low temperature. That is, the sparsely acetificated PVA fibers serve to bond fibers together during the process of drying the wet packaging container even though they serve as fiber components in the pulp slurry along with pulp and carbon fibers during the process of molding the packaging container. As a result, the sparsely acetificated PVA fibers increase various strengths of the packaging container by 2 or 3 times. In particular, the sparsely acetificated PVA fibers increase the bending strength of the packaging container by 8 to 10 times.

For melamine resin, a melamine resin solution is used which is prepared by dissolving melamine resin powder in an aqueous solution added with a desired amount of acid (hydrochloric acid). The melamine resin solution may be used in a state diluted by water, if necessary. Melamine resin particles are easily adsorbed onto pulp fibers because they exhibit electrostatic charge. Accordingly, the melamine resin serves to greatly increase the wet strength of the molded packaging container after the curing of the packaging container. For urea resin, a cationic urea resin is used. Preferably, urea resin, in which polar groups such as amino groups or imino groups are included in resin molecules, is used. The urea resin is added to the pulp slurry in a state dissolved in water. The urea resin is well adsorbed into pulp fibers and serves to increase the wet strength of the molded packaging container after the curing of the packaging container.

Starch is added in a small amount to the pulp slurry. For starch, a gelatificated starch is used.

Meanwhile, aluminum sulfate serves to isolate safonificated rosin and bonds the free safonificated rosin to the fiber components of the pulp slurry. The aluminum sulfate also serves to adsorb the urea resin to the fibers, thereby achieving a maximum adsorption yield of urea resin to pulp fibers. Starch exhibits a very low yield ranging from 10% to 50% when it is applied to unsized paper. This is because starch has a low affinity to cellulose. However, the yield can be greatly improved when aluminum sulfate is added.

As apparent from the above description, the function of aluminum sulfate is important in the method of the present invention in that aluminum sulfate serves to fix rosin, urea resin, and starch to pulp fibers.

In the packaging container making apparatus of the present invention, the pores 8' of the lower mold 8 are uniformly arranged. Preferably, the pores 8' have a diameter of 0.1 mm to 1.5 mm and a pitch corresponding to 0.5 to 3 times the diameter.

Preferably, the suction force exerted in the suction chamber 7 ranges from 0.8 atm. to 0.5 atm. When the suction force is less than the lower limit, a degradation in workability occurs. On the other hand, where the suction force is more than the upper limit, the amount of fibers passing though the pores 8' increases, thereby degrading the molding yield of fibers.

Such limitation may also be applied to the size of the pores provided at the molds.

In the molding tank 3, the fibers of the pulp slurry are deposited onto the upper surface of the lower mold, namely, the lower mold surface, by virtue of the suction force exerted in the suction chamber 7. At this time, the solution of the pulp slurry is sucked into the suction chamber 7 through the pores 8' of the lower mold 8 and then fed to the pulp slurry making chamber 1 via the hose 5 so that it is reused in a pulp slurry making process.

The pores of the upper mold 12 have a relatively large size. Preferably, the suction force exerted in the air sucking and blowing chamber 11 is approximately equal to that exerted in the suction chamber 7. By such a level of suction force, it is possible to separate the molded packaging container 13 from the lower mold 8. Preferably, the pneumatic pressure exerted in the air sucking and blowing chamber 11 during the air blowing operation ranges from 0.1 kg/cm to 0.5 kg/cm. By such a level of pneumatic pressure, it is possible to separate the molded packaging container 13 from the upper mold 12.

In the drying process, drying of the molded packaging container 13 is carried out. As the temperature of the molded packaging container 13, which is in a wet state, increases during the drying process, the sparsely acetificated PVA fibers in the molded packaging container 13 are melted, thereby causing the pulp fibers to be bonded together and to be bonded with carbon fibers. As a result, a desired strength is generated in the molded packaging container 13 after the drying process. Furthermore, an enhancement in the bonding force among the fibers is obtained by virtue of the fact that the melamine or urea resin in the molded packaging container 13 is cured. In addition, an enhancement in the strength of the molded packaging container 13 is obtained.

As apparent from the above description, the inner packaging container made in accordance with the present invention has a sparse structure, but feels flexible to the touch, because it is not processed by a process using a roller or drum as in conventional papermaking methods. In accordance with the present invention, a desired strength of the packaging container is obtained from a bonding force provided by the sparsely acetificated PVA fibers and a strength resulting from the curing of the melamine or urea resin. Carbon fibers having a conductivity are distributed throughout the packaging container. Accordingly, it is possible to obtain an anti-electrostatic effect. By virtue of such an anti-electrostatic effect, it is possible to prevent an electronic element in an electronic circuit or electronic appliance, which is packaged by the packaging container, from being damaged due to static electricity. Since the packaging container of the present invention has an integral structure, it may be a high-grade packaging container.

In addition, the packaging container of the present invention, which uses pulp as its principal constituent, may be a product to be highlighted as an environmentally affinitive packaging container, taking into consideration the current global tendency to avoid the use of packaging containers made of synthetic resin materials resulting in environmental pollution.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

I claim:

1. An apparatus for making an anti-electrostatic packaging container comprising:

a pulp slurry making tank;

a molding tank for receiving a pulp slurry supplied from said pulp slurry making tank via a pipe;

a hydraulic device arranged beneath the molding tank, said hydraulic device having a vertically reciprocating piston extending vertically through a bottom wall of said molding tank into the interior of said molding tank;

a lower mold arranged in the interior of said molding tank and mounted at a bottom wall thereof to an upper end of said piston in such a fashion that it moves vertically in said molding tank in accordance with a reciprocal movement of said piston, said lower mold having a top wall perforated with a number of pores and adapted as a lower surface of a mold cavity;

a suction chamber defined in said lower mold beneath said top wall of said lower mold and connected to a motor installed outside said molding tank via a flexible hose extending from said motor to the interior of said molding tank, said suction chamber communicating with the interior of said molding chamber via said pores perforated through said top wall of said lower mold;

an upper mold arranged in a fixed state near a top wall of said molding tank in the interior of said molding tank in such a fashion that it is vertically aligned with said lower mold, said upper mold engaging with said lower mold at edges thereof to define said mold cavity therebetween and having a bottom wall perforated with a number of pores and adapted as an upper surface of said mold cavity; and an air sucking and blowing chamber defined in said upper mold and connected to a reversible motor installed outside said molding tank via an air pipe extending from said reversible motor to said upper mold, said air sucking and blowing chamber communicating with said mold cavity via said pores perforated through said bottom wall of said upper mold.

2. A method for making an anti-electrostatic packaging container using a packaging container making apparatus according to claim 1, comprising the steps of:

dispersing beaten sulfite pulp and carbon fibers in water, adding, to the resulting aqueous solution, rosin and aluminum sulfate as sizing agents, sparsely acetificated PVA fibers and a melamine resin or urea resin as additives, and a starch material, and sufficiently stirring the resulting mixture in said pulp slurry making tank, thereby producing a pulp slurry;

supplying said pulp slurry from said pulp slurry making tank to said molding tank until said lower mold is completely immersed in said supplied pulp slurry in said molding tank;

generating a suction force in said suction chamber by an operation of said motor, thereby depositing fiber components of said pulp slurry to a desired thickness over said top wall of said lower mold;

stopping said operation of said motor, and then upwardly moving said lower mold by an operation of said hydraulic device until said lower mold comes into contact with said upper mold, thereby molding said deposited fiber components of said pulp slurry into a packaging container while dewatering said molded packaging container;

generating a suction force in said air sucking and blowing chamber by a normal operation of said reversible motor while downwardly moving said lower mold, thereby separating said molded packaging container from said lower mold;

blowing air into said air sucking and blowing chamber by a reverse operation of said reversible motor, thereby separating said molded packaging container from said upper mold; and drying and curing said molded packaging container for 10 to 20 minutes while passing said molded packaging container through a drying tunnel maintained at a temperature of 50 to 120° C.

* * * * *